United States Patent [19]

Whalen-Shaw et al.

[11] 4,340,659

[45] * Jul. 20, 1982

[54] ELECTROSTATIC MASTERS

[75] Inventors: Michael J. Whalen-Shaw, Paw Paw; Robert J. Thiessen, Richland, both of Mich.

[73] Assignee: Allied Paper Incorporated, Kalamazoo, Mich.

[ * ] Notice: The portion of the term of this patent subsequent to Oct. 6, 1998, has been disclaimed.

[21] Appl. No.: 53,168

[22] Filed: Jun. 29, 1979

Related U.S. Application Data

[63] Continuation-in-part of Ser. No. 827,127, Aug. 24, 1977, abandoned.

[51] Int. Cl.[3] ..... B05D 5/12

[52] U.S. Cl. ..... 430/64; 427/58; 427/121; 427/336; 427/411; 427/412; 430/65; 101/463.1; 101/466

[58] Field of Search ..... 427/355, 308, 303, 336, 427/364, 366, 390 E, 391, 411, 428, 121, 335, 361; 162/135; 428/136, 336, 342, 530, 514; 101/463, 457, 462; 430/64, 65, 138, 531, 536, 537, 961

[56] References Cited

U.S. PATENT DOCUMENTS

| | | | |
|---|---|---|---|
| 3,281,267 | 10/1966 | Rice | 428/328 |
| 3,443,946 | 5/1969 | Grabhöfer et al. | 430/537 |
| 3,520,861 | 7/1970 | Thompson et al. | 428/500 |
| 3,541,033 | 11/1970 | Buttrick et al. | 260/8 |
| 3,653,894 | 4/1972 | Levy et al. | 430/63 |
| 3,674,896 | 7/1972 | Purcell et al. | 260/29.6 H X |
| 3,741,925 | 6/1973 | McDonald | 260/28.5 R |
| 3,765,924 | 10/1973 | Craven | 427/336 |
| 3,779,800 | 12/1973 | Heiser | 260/29.6 RB X |
| 3,799,901 | 3/1974 | McCann et al. | 260/29.6 PM X |
| 3,839,033 | 10/1974 | Matsuno | 430/64 |
| 3,872,039 | 3/1975 | Vaughn et al. | 260/17.4 ST |
| 3,899,389 | 8/1975 | Vaughn et al. | 162/168 |
| 3,949,138 | 4/1976 | Heiser | 428/323 |
| 3,968,319 | 7/1976 | Mani et al. | 428/511 |
| 3,996,056 | 12/1976 | Muller | 430/157 |
| 4,081,584 | 3/1978 | Akiyama et al. | 427/388 C X |

FOREIGN PATENT DOCUMENTS

| | | | |
|---|---|---|---|
| 594688 | 3/1960 | Canada | 430/537 |

*Primary Examiner*—Norman Morgenstern
*Assistant Examiner*—Thurman K. Page
*Attorney, Agent, or Firm*—Richard H. Thomas

[57] ABSTRACT

An electrostatic master having improved water, cockle and pick resistance for lithographic printing, and method for making the same, comprising a base, a barrier coat applied to said base, and a photoconductive layer containing a photoconductive material and binder applied to said barrier coat. The barrier coat preferably comprises a copolymer of at least 60% ethylenically unsaturated polymerizable monomer having non-polar functionality and about 3 to about 40% of a polymerizable olefinically unsaturated monomer having polar functionality. The barrier coat preferably contains about 2.5 to about 50% plastic particles based on the weight of the barrier coat. The barrier coat achieves improved water resistance at low coat weights, and thus can be applied without substantial change in conductivity.

28 Claims, No Drawings

ELECTROSTATIC MASTERS

The present application is a continuation-in-part of prior application Ser. No. 827,127 (now abandoned) on Water and Solvent Resistant Coated Paper and Method for Making the Same, filed Aug. 24, 1977, and assigned to assignee of the present application.

The present invention relates to electrostatic masters for lithographic printing, and has application for long-run, short-run and medium-run masters.

The present invention will be described specifically with respect to the preparation of paper masters, but has application in the preparation of other types of masters where water resistance is desired.

BACKGROUND OF THE INVENTION

Paper electrostatic masters for lithographic printing, and the methods for making the same, are well known. Lithography depends upon the immiscibility of a greasy lithographic printing ink and an aqueous etch or lithographic solution. In use, a paper lithographic master is first imaged in a known manner, and the imaged plate is then placed on a plate cylinder of an off-set duplicating press. The overall surface of the plate is treated with an aqueous wet-out or fountain solution which wets all portions of the plate except those areas which have been imaged and are water-repellant. The press inking rolls then pass over the surface of the plate and deposit a film of ink only upon the ink-receptive image areas. In the printing operation in ink from the imaged areas is transferred in reverse to a rubber off-set blanket which in turn prints directly onto a paper sheet so as to form a copy.

Although imaging of the master can be obtained in a number of ways, the present invention is concerned with the preparation of masters suitable for imaging by photoelectrostatic reproduction. This type of reproduction depends upon the presence of a light sensitive photoconductive pigment dispersed in an insulating matrix of a resinous, film-forming material. An electrostatic charge is applied to the surface of the photoelectrostatic coating in the absence of light, and on exposure of the charged surface to an optical image, the charge is dispersed except in those areas which are imaged. Toning of the surface then converts the electrostatic image to a permanent visible image which is ink receptive.

In order to obtain a satisfactory dispersal of charge in non-imaged areas, it has been found necessary to provide under the photoconductive coat an electroconductive sub-coating through which the charge dispersal occurs. Many ways have been proposed to obtain this conductivity, for instance through the use of inorganic salts, humectants, quaternary ammonium compounds and electroconductive polymers.

In the case of lithographic plates, if the aqueous fountain solution works into the body of the paper, the surface of the plate may become less completely wetted-out by water because water has been withdrawn from the surface into the plate. Therefore, the surface may not repel the printing ink, and areas of the surface which should be perfectly blank will darken or "tone".

In addition, absorption of water into the base paper is likely to cause fiber swelling and dimensional expansion in a cross-machine direction, in turn causing buckle or what is known as cockle of the master. As the master enters various nips on the printing press, the cockle is flattened creating a crease. This crease then picks up ink which reproduces on copies causing a streak.

These and other difficulties are particularly great when the plates are used for long runs and are therefore subjected to repeated wettings and inkings. Attempts have been made to overcome these difficulties by employing water-resistant barrier coatings beneath the photoconductive layer. A typical barrier coat may contain on a weight basis about 15% styrene-butadiene latex, about 5% casein or protein and about 80% filler, primarily coating clay. However, these barrier coatings, particularly when applied from highly concentrated solutions, are not compatible for use with conventional conductive agents. For instance, conductive salts tend to precipitate the latices in solution. Conductive polymers are cationic, and are incompatible with the anionic latices. In addition, the latices are very dielectric and coats containing such latices, when applied in the coat weights necessary to achieve adequate water hold-out, are insufficiently conductive.

In copending application Ser. No. 930,329 (now abandoned) assigned to assignees of the present application, filed by Michael J. Shaw et al on Aug. 2, 1978, there is disclosed an electrostatic paper master comprising a paper base, a barrier coat, and a photoconductive layer, the barrier coat comprising a binding amount of a binder resin and a filler at least a portion of which is an amount of plastic particles sensitive to the solvent used in the application of the photoconductive layer. The plastic particles are in an at least partially coalesced state in said barrier coat. A binding amount preferably is about 10 to about 40% binder based on the total weight of the filler. Preferably the plastic particles are selected from the group consisting of polystyrene, polyvinyl acetate and copolymers thereof, polyvinyl butyral and copolymers thereof and polyacrylate and copolymers thereof. The disclosure of said prior patent application is incorporated by reference herein.

SUMMARY OF THE PRESENT INVENTION

The present invention is distinguished from the invention of prior application Ser. No. 930,329, in that the barrier coat consists essentially of a film-forming polymer and about 5–100% by weight plastic particles, based on the weight of the film-forming polymer, the plastic particles having solvent sensitivity and being in at least a partially coalesced state. It was found that by the present invention, employing said film-forming polymer as defined, with about 5–100% plastic particles based on the binder weight, much improved water resistance could be obtained, in paper lithographic masters, at much reduced coat weights. Specifically, by contrast with the invention of Ser. No. 930,329, where formula solids (binder and filler) range preferably from about 50–63% and coat weights range from about 5 to 20 pounds per side (dry basis) per 3,300 square feet, the present invention is concerned with a baarrier coat formulation having a preferred solids content (binder and filler) of about 20–40% and coat weights from about 0.2 to 20 pounds per side (dry basis) per 3,300 square feet. By the present invention, superior water resistance can be obtained with as little as a tenth of the total coat weight.

By using the barrier coat of the present invention at lower coat weights, formation of a dielectric barrier, which would prevent charge migration from the photoconductive layer on exposure to light, is avoided. The present invention also permits increased coating speeds with superior product performance, improved roll conditions due to the lower coat weights and elimination of corrugations, heavy spots, ridges and streaks due to poor profiling or drying uniformity. Also unexpectedly it was found, in accordance with the concepts of the present invention, that a preferred range of about 20–40% plastic particles (dry basis, based on the total coat weight), with the film-forming polymer, provided improved resistance to picking, over formulations containing lesser amounts of plastic particles.

Preferably, the present invention resides in a paper lithographic master comprising a polymeric, film-forming, barrier coat and an overlying photoconductive layer, the barrier coat consisting essentially of (a) a synthetic film-forming polymer selected from the group consisting of co- and multipolymers of ethylene or propylene and acrylic, methacrylic or crotonic acid; co- and multipolymers of polyvinyl acetate; co- and multipolymers of styrene-butadiene; esters of polyacrylic, methacrylic and crotonic acid and multipolymers thereof; and co- and multipolymers of acrylic, methacrylic and crotonic acid and polyvinylidene chloride and mixtures thereof; and (b) about 5–100% by weight, based on the weight of the film-forming polymer, of plastic particles having solvent sensitivity; said plastic particles being in at least a partially coalesced state by contact with a solvent to which they are sensitive. In an embodiment of the present invention, said solvent is that employed in the application of the overlying photoconductive layer.

In a further embodiment of the present invention, the lithographic master further comprises an underlying pre-coat comprising binder and filler, at least 10% of said filler being plastic particles having solvent sensitivity.

In another respect, the present invention resides broadly in the preparation of a paper lithographic master wherein the barrier coat comprises a copolymer of an ethylenically unsaturated polymerizable monomer having non-polar functionality such as ethylene and a polymerizable olefinically unsaturated monomer having polar functionality such as acrylic, methacrylic or crotonic acid, or salt thereof. By the use of such copolymer, unexpectedly improved water resistance at very low levels of coat weight and other beneficial properties for masters are achieved.

Broadly, the film-forming polymer of the present invention can be any synthetic or natural polymer having binding properties; suitable such natural polymers including starch, modified starch, casein, soybean protein, and natural gums.

Synthetic film-forming binders for the present invention may be prepared by emulsion or suspension polymerization, and are preferred for use in the present lithographic master. Principally, the film formers provide the advantage of superior water hold-out or resistance, particularly when the masters are subjected to multiple wettings by the fountain solution in lithographic printing. As many as 10,000 copies or more can be run on the long-run masters of the present invention.

Several film formers suitable for use in the present invention are avaiable commercially. These include butadiene-styrene latices (Latex 512R, trademark, Dow Chemical) containing 35–55% total solids; vinyl chloride latices containing 50–55% total solids; vinylidene chloride-acrylonitrile copolymers (Saran F 122-A 15, trademark, Dow Chemical); polystyrene latices containing 35–45% solids; vinyl ester latices such as polyvinyl acetate containing 40–55% total solids (Gelva S-55, trademark), Shawinigan); latices of polyvinyl acetate-polyvinyl chloride (Resyn 2507, trademark, National Starch) containing 40–50% total solids; butadiene-acrylonitrile copolymers (Hycar 1577, trademark, Goodrich); styrene-acrylonitrile latices, polymethylmethacrylate latices and butadiene-acrylic ester latices. The latices usually have an average molecular weight in a range of about 25,000 to about 100,000. Other resins suitable for forming aqueous latices ar polyvinyl chloride, polyvinylidene chloride, vinyl chloride-styrene, vinyl chloride-butadiene, vinyl chloride-acrylonitrile, methyl methacrylate-styrene, acetal polymers and copolymers, isoprene polymers, chlorinated rubber, polyvinyl butyral, styrene-ethylene copolymers, polyfluoroethylene, polyvinylidene fluorides and polyurethane.

A preferred synthetic polymer for use in the barrier coat of the present invention is an ethylene acrylic acid copolymer manufactured under the trademark XD8931, by Dow Chemical Company, containing about 80% ethylene and 20% acrylic acid. Such copolymers are disclosed in U.S. Pat. Nos. 3,520,861 and 3,799,901, both assigned to Dow Chemical Company. The subject matter of said patents is incorporated by reference herein.

Preferably, the barrier coats are applied to a paper base, which may or may not have a pre-coat, in the amount of about 0.2 to 20 pounds per side (dry basis) per 3,300 square feet. Thus for purposes of the present application, the term "paper base" shall mean a paper sheet having a pre-coat as well as one having no pre-coat. The barrier coats may be applied by any of the usual methods, for instance on a size press, by blade, rod or roll coating using known technology and apparatus, or by an air knife coater. Preferably, the barrier coat of the present invention is applied only on the functional side where water resistance is required (that side to which the photoconductive layer is applied). However, it may be desirable to also apply it to the back side, for example, to avoid curl, particularly if solvent resistance is also desired. In general, thickness of the barrier coat will depend upon the amount of water or solvent resistance desired, the thicker the coat, the more the water and solvent resistance.

In the barrier coat, when plastic particles are used, the amount of plastic particles preferably will vary between about 5% to about 100%, based on the amount of film-forming polymer employed, and dependent on the type of film-forming polymer. More preferably, the plastic particle content of the barrier coat is from about 20 to about 40% based on the total coat weight, for both improved pick as well as water resistance. The data of this application will show that improved water resistance can be obtained with as little as zero percent plastic particles when the film-forming polymer is ethylene acrylic acid or similar copolymer; whereas, as high as 40% plastic particles is desired with film-formers that have less water resistance, such as starch.

By similar, it is meant a film-forming copolymer of an ethylenically unsaturated polymerizable monomer having non-polar functionality and a polymerizable olefinically unsaturated monomer having polar functionality, as aforesaid described.

The type of plastic particle is not critical, so long as it is impervious to water and/or solvents but sensitive to the solvent system employed in the wetting of the barrier coat or application of the photoconductive layer. In the case of electrostatic paper masters bearing zinc oxide containing coatings, the zinc oxide is normally applied from about a 50% dispersion in a solvent such as toluene. The plastic particles thus should be sensitive to toluene or the solvent used. Other solvents which may be employed are aromatic compounds such as benzene, xylene, chlorinated aliphatic compounds such as methylene chloride, and ketones such as acetone and methylethyl ketone, and others known in the art.

The discrete plastic particles of the present invention comprise any non-film forming organic polymer which is water-insoluble and is insoluble in the particular binder used in the barrier coating formulation. By "non-film forming", it is meant that the dispersed plastic particles do not coalesce to form a film at ambient temperature and at temperatures and pressures selected to dry or finish the coated paper. However, since the novelty of the present invention resides in improved performance as a result of solvent attack on the plastic particles, it shall be understood that the present invention broadly does not preclude tht process wherein calendering temperatures and pressures may cause deformation and some coalescence of the plastic particles. Preferred polymers, however, are thermoplastic organic polymers. Especially preferred polymers are also classified as resinous and are substantially colorless, although this is dependent in part on the particular application involved.

A large number of prior patents have been granted on the use of plastic particles in paper coating formulations. Representative U.S. Pat. Nos. are 3,968,319; 3,949,138; 3,779,800; 3,996,056; and 3,,281,267. With regard to the types of plastic particles employed, the disclosures of these prior patents are incorporated by reference herein. Insofar as is known, no patents have issued disclosing the use of plastic particles in a paper coating formulation, for instance for lithographic masters, to obtain improved water or solvent resistance.

Examples of suitable materials which may be employed in the preparation of the plastic particles, sensitive to the above-mentioned solvents, to effect water or solvent resistance, include polystyrene, polyvinyl acetate and copolymers thereof, polyvinyl butyral and copolymers thereof, polyacrylates and copolymers thereof, and mixtures of any of the above. Not included are plastic materials which are inherently water attractive or water sensitive under conditions where a lithographic master is normally used.

Somewhat better results are obtained with plastic particles of smaller size. A preferred range for average particle size is between about 0.01 and 20.0 microns.

Wherein the barrier layer of the present invention consists essentially of a film-forming polymer and plastic particles, this does not exclude the use of small amounts of additional pigment materials, for instance clay, silica, calcium carbonate and alumina, which may be added to the barrier coat formulation to provide properties such as smoothness to the coated paper. Also, materials such as conductive carbon, anionic and cationic conductive polymers, montmorillonite clays, hydrated alumina, colloidal alumina and silica, salts and polyhydric compounds may be added to the barrier coat formulation to obtain improved conductivity in the barrier coat.

It is recognized that the use of the above materials in small quantities, such as about 5%, may have beneficial effects on the desired properties for a master. With further addition of the above materials, a trade-off with water resistance can be expected.

In a preferred form of the present invention, the plastic particles of the barrier coat are sensitive to the solvent system employed in the photoconductive layer of the master; for instance toluene. It is believed that the plastic particles are swollen, or partially or totally dissolved in the solvent system for the photoconductive layer such that when the solvent used is evaporated, a coalesced, semi- or totally continuous plastic film is formed.

Alternatively, the barrier coat may be treated separately by toluene or another solvent, to which the plastic particles are sensitive independent of, but prior to, application of the ZnO or other photoconductive coat. It is understood that the photoconductive layer can be a conventional ZnO/toluene coat, or can be any other photoconductive layer known to those skilled in the art.

In the present invention, water resistance is measured in terms of water absorption employing a standard test, such as a Cobb test described in TAPPI Standards and Testing Methods P441M.

Preferably the paper lithographic master of the present invention also comprises a pre-coat which underlies the barrier coat. The function of the pre-coat is to smooth irregularities in the surface of the base paper and also to provide a conductive path through the paper sheet to the back side of the sheet and to ground and thus to prevent lateral leakage in the barrier coat. Such pre-coats are well known and will comprise typically a styrene-butadiene, acrylic or polyvinyl acetate latex or polymer formulation containing conventional barrier additives such as protein, casein, clay, pigments and fillers in addition to a conductive agent such as conductive polymer, humectants, conductive salts, quaternary ammonium compounds and the like. In the pre-coat formulations of the present invention, the latex concentrations are relatively small, e.g., 10–20% so that compatibility of certain additives such as most conductive agents with the latices is less critical. Preferably, the pre-coat formulations of the present invention also comprise an amount of plastic particles, preferably in the range of about 10–20% based on the total filler content.

The electroconductive coating of the present invention may be used with any conventional inorganic photoconductive layer which provides the electronic charge generation necessary to perform the electrophotographic discharge. Photoconductive zinc oxide is preferred for efficiency and economy. Suitable photoconductive zinc oxides are commercially available under the names Photox 80 and Photox 801 (trademark, New Jersey Zinc Company); PC 321, PC 331 and PC 340 (trademark, St. Joseph Lead Company) and ZZZ-66-1 (trademark, American Zinc Smelting Company). Suitable photoconductive insulating top coatings are disclosed in U.S. Pat. Nos. 2,959,481; 3,052,539 and 3,431,106.

The present invention and advantages thereof will become more apparent from the following examples.

In the following examples, data is given on three tests conducted on comparative samples; a Cobb test described above, measuring water resistance; a Cockle test, which is simply a measure of the time it takes for either the base paper or the master to show cockling or buckling (the measure is in terms of seconds, the longer the time, the more resistant the master is to cockling); and a Pick test. When an electrostatic master runs in a printing press it is subject to an ink film split which takes place between the master and the ink roller. The higher the tack of the ink that is used, the greater the tendency for the master to rupture at the weakest point of construction. Historically, the weakest point has been at the zinc oxide-base paper interface. In some equipment, both ink and water are transferred to the master surface with the same roller. The affect of water is to loosen all interfacial bonds. The following wet and dry pick test was found to correlate well with the tendency towards picking in a printing press.

The test is as follows:

PROCEDURE FOR I.G.T. PICKS - WET AND DRY

MATERIALS:

I.G.T. Tester — "Instituut voor Grafische Technick T.N.O. Amsterdam 0.1-0.6" 35" 20"
Supplied by: Rudolph Meijer's Inc. Amsterdam, Holland Brouwersgracht 152/154
Equipped with 2 speeds (A = slow - 450 ft/min. maximum velocity and B = fast - 650 ft/min. maximum velocity) an adjustable pressure device and a spring drive device.

Inks — Inmont IPI Printing Inks - Black

Inking Apparatus — Timken A-2037
Single disk (of 9 mm width and 8" circumference) with a doctor-blade type metering device set for a 2 mil ink thickness PROCEDURE: This procedure is a modification of TAPPI suggested method T 499 su-64.
Samples were conditioned for ≧15 hours at 50% Rh prior to testing.
Strips were cut 1" × 10" along the machine direction from areas free from wrinkles, creases, etc. The strips were handled only by the edges so that the surface was free of oil and fingerprints.
Ink was applied directly to the inking apparatus disk with a spatula and the disk was turned in a clockwise direction in order to evenly distribute the ink over the entire surface at a 2 mil thickness.
A #8 tack ink was used for the wet picks. The strips were completely submersed in water and allowed to soak for 5 minutes. The strips were then blotted to remove the excess water and tested immediately.
Pick results were recorded as distance in cm from the top of the inked area of the sample to the pick itself. The first sign of ink or fiber pick, no matter how small, was designated as the "1st pick". The point of total ink or fiber pick was designated as the "major pick".
In general, it can be said the larger the pick distance in centimeters, the better the pick test.

EXAMPLE 1

A precoated sheet of 65 pounds per 3,300 square feet weight was blade coated on both sides with a pre-coat, at the rate of about 10 pounds per side. The pre-coat formula consisted of 5% protein, 15% styrene-butadiene latex and 10% Dow 722 Plastic Pigment based on 100 parts of No. 2 Kaolin Coating Clay (No. 2 HT Coating Clay, trademark, Englehart Minerals and Chemicals Corp.). The Dow 722 plastic particles (trademark, Dow Chemical Company) are of polystyrene and have an average particle size of about 0.50 microns. About 10% of a melamine-formaldehyde cross-linking agent, based on the amount of binder, was also used in the formulation. This precoated paper was then given one nip steel-to-steel calendering at 60 psi.

The paper was then blade coated on the wire side with a formulation consisting essentially of varying amounts of Dow 722 Plastic Pigment with Dow XD8931 ethylene acrylic polymer. About 0.5 pounds per 3,300 square feet (dry basis) of the formulation was applied. The paper, following drying, was then tested for water resistance using the aforementioned Cobb test.

Samples of the paper were also rod coated with toluene or a zinc oxide suspension in toluene and tested again for water resistance using a Cobb test. The results are presented in the following Table A.

In addition to the Cobb test, the samples were also subjected to Cockle and Pick tests, the results of which are also given in Table A.

For purposes of comparison, a control test was also run. The control contained the above noted pre-coat without the barrier coat of the present invention. The pre-coat was applied to both sides at the rate of 10 pounds per side. Data obtained for the control is better than that which would be obtained from a conventional single or multi-pass barrier coat, because of the use of plastic particles in the control.

TABLE A (Plastic Particles in Pre-Coat)

| % Plastic Particles in Barrier Coating** | No Treatment | | | Toluene Treated | | | ZnO Coated | | | | |
|---|---|---|---|---|---|---|---|---|---|---|---|
| | 2½ Min.* Cobb Test | 10 Min. Cobb Test | # Seconds To Cockle | 2½ Min. Cobb Test | 10 Min. Cobb Test | # Seconds To Cockle | 2½ Min. Cobb Test | 10 Min. Cobb Test | # Seconds To Cockle | IGT Wet Pick Test cm. | IGT DRY Pick Test cm. |
| Control coating | 21.7 | 32.9 | 20 | 9.2 | 31.2 | 52 | 2.6 | 12.8 | 58 | 8.4 | 10.5 |
| 0 | 1.9 | 12.3 | 95 | 0.8 | 8.0 | 152 | 1.1 | 1.8 | 100 | 7.0 | 3.9 |
| 5 | 1.4 | 8.9 | 105 | 0.6 | 3.7 | 160 | 0.7 | 1.8 | 342 | 6.3 | 3.7 |
| 10 | 2.7 | 14.8 | 65 | 0.3 | 3.2 | 242 | 0.8 | 1.4 | 398 | 6.7 | 5.5 |
| 20 | 3.2 | 18.5 | 60 | 0.5 | 3.6 | 145 | 1.0 | 1.7 | 169 | none | 4.9 |
| 25 | 4.0 | 22.1 | 60 | 0.4 | 4.0 | 210 | 1.3 | 2.1 | 166 | 11.3 | 8.9 |
| 30 | 4.1 | 22.4 | 60 | 0.5 | 4.6 | 138 | 1.1 | 2.1 | 562 | none | 7.2 |
| 40 | 4.5 | 24.0 | 48 | 0.5 | 4.2 | 225 | 1.0 | 2.0 | 458 | none | 7.5 |

*Cobb tests expressed in gm./m$^2$ of water absorbed
**Based on weight of entire coat following drying From the data of Table A it is seen that use of the ethylene acrylic polymer by itself (with no plastic particles in the formulation) makes a large improvement in water resistance. For instance, referring to the 10 minute Cobb test, without treatment ("No Treatment"), the Control gave 32.9 grams of water absorbed, compared to 12.3 grams for the ethylene acrylic polymer barrier coated sheet without plastic particles. With a toluene treatment, values of 31.2 versus 8.0 were obtained. In the ZnO coated sheets, values of 12.8 versus 1.8 were obtained. By the addition of even low levels of plastic particles (5%), followed by toluene treatment, the water resistance is even further improved, to 3.7 grams water absorbed. By the addition of even a greater percentage of plastic particles, for instance 10%, still further water resistance is achieved.

Examining the data on sheets coated with zinc oxide, it can be seen that about 5 to 40% use of plastic particles shows a large increase in the time it takes for a master to cockle. For exaple, on ZnO coated masters, the Control cockled in 58 seconds. Using the barrier coating with zero percent plastic particles, a Cockle resistance of 100 seconds was obtained, whereas when 10% plastic particles were included in the barrier coating, a cockle resistance of 398 seconds was obtained. Again, cockle is a good measure of the resistance of a master to tail cracking.

The dry, and most importantly, wet pick test data in Table A shows significant improvement at levels of 20% plastic particles or more over the use of barrier coatings without plastic particles. It will be recalled that the larger the pick distance in centimeters, the better the pick test. This is extremely important for masters, particularly for long-run masters. The use of plastic particles, preferably at 20 to 40% level, based on the weight of the entire coat following drying, in combination with the film-forming polymer, achieves not only high water resistance, but also avoids zinc oxide picking. "None" in Table A means no picking. The wet pick test data is the most significant since masters are run under wet conditions on a printing press.

EXAMPLE 2

The purpose of this example is to show the synergistic effect of using a pre-coat or control coating which contains plastic particles, in combination with the barrier coat of the present invention, over use of a pre-coat that has no plastic particles. The same precoated paper described in Example 1 was employed, except that the precoating did not contain any plastic particles. The results are summarized in the following Table B, and can be compared with Table A wherein the precoating did contain plastic particles.

It can be noted that the pre-coat or control coating of Table V, without plastic particles, was similar or equivalent to a conventional barrier coat formulation employed in the prior art.

TABLE B

| Particles in Barrier Coating | No Treatment (No Plastic Pigment in Pre-Coat) | | | Toluene Treated | | | ZnO Coated | | | | |
|---|---|---|---|---|---|---|---|---|---|---|---|
| | 2½ Min.* Cobb Test | 10 Min. Cobb Test | # Seconds To Cockle | 2½ Min. Cobb Test | 10 Min. Cobb Test | # Seconds To Cockle | 2½ Min. Cobb Test | 10 Min. Cobb Test | # Seconds To Cockle | IGT Wet Pick Test cm. | IGT Dry Pick Test cm. |
| Control coating | 20.5 | 40.4 | 19 | 17.5 | 31.2 | 19 | 3.7 | 13.4 | 62 | 14.5 | 16.8 |
| 0 | 8.6 | 26.5 | 38 | 4.6 | 20.0 | 43 | 1.1 | 2.6 | 283 | 7.1 | 2.6 |
| 5 | 8.6 | 24.4 | 35 | 4.0 | 18.3 | 48 | 0.9 | 2.8 | 184 | 7.6 | 3.0 |
| 10 | 8.5 | 36.1 | 35 | 4.2 | 18.1 | 54 | 1.6 | 2.7 | 220 | 7.9 | 5.8 |
| 20 | 8.2 | 33.0 | 40 | 3.0 | 19.5 | 74 | 1.1 | 2.1 | 169 | 8.6 | 14.3 |
| 25 | 7.8 | 28.2 | 37 | 3.0 | 18.3 | 74 | 1.2 | 2.3 | 222 | 6.3 | none |
| 30 | 8.0 | 25.2 | 40 | 2.7 | 18.7 | 82 | 1.6 | 2.3 | 483 | 7.6 | 16.7 |
| 40 | 5.9 | 25.8 | 39 | 2.9 | 18.4 | 81 | 1.3 | 2.1 | 208 | 7.5 | none |

*Cobb tests expressed in gm./m$^2$ of water absorbed.

Comparing the results of Table B with the data of Table A, it can be seen that, with all levels of plastic particles between about 0 to about 40%, in the barrier coat, improved water, cockle and pick test data are obtained when plastic particles are used in the pre-coat (Table A). This was not expected, based on the fact that the precoated sheets themselves (with and without plastic particles) had no significant difference in water resistance. This synergism for precoated base paper (containing plastic particles) is reflected in the water resistance values for both the toluene treated and zinc oxide treated sheets.

It should be noted that from the data of Table B, the dry pick resistance of the zinc oxide coated sheets shows substantial improvement at the level of 20% plastic particles in the barrier coat (or higher) despite the absence of plastic particles in the pre-coat.

The comparative data of Tables A and B also show that up to a five-fold difference in 10 minute Cobb tests, depending on the level of plastic particles in the barrier coating, is observed, when employing plastic particles in the pre-coat. Comparing values of 10 minute Cobb tests between the two types of precoated bases that have been toluene treated and have 0% plastic pigment (in the barrier coat), the data shows a 20/8 or a factor of 2.5 improvement. This suggests a possible interaction of the ethylene acrylic polymer with the precoated paper that has plastic pigment in it. This further indicates that the preferred embodiment of the present invention includes plastic particles in the pre-coat.

EXAMPLE 3

This example illustrates the effectiveness of the concepts of the present invention employing film-forming polymers other than the ethylene acrylic polymer of Example 1. In this example, the following materials were examined:

| Barrier Coat Designation | Barrier Coat Formulation |
|---|---|
| A | Ethylene acrylic polymer Dow XD8931 |
| B | Ethylene acrylic polymer Dow XD8931 plus 25% Dow Plastic Pigment 722 |
| C | Styrene-butadiene Polymer 620 (trademark, Dow Chemical Company) |
| D | Styrene-butadiene Polymer 620 plus 25% Dow Plastic Pigment 722 |
| E | Polyvinyl Acetate Terpolymer 6170 (trademark, Celanese Corporation) |
| F | Polyvinyl Acetate Terpolymer 6170 plus 25% Dow Plastic Pigment 722 |
| G | Polyvinylidene Chloride Saran 120 (trademark, Dow Chemical Company) |
| H | Polyvinylidene Chloride Saran 120 plus 25% Dow Plastic Pigment 722 |
| I | Polyacrylate Polymer B15 (trademark, Rohm and Haas) |

-continued

| Barrier Coat Designation | Barrier Coat Formulation |
|---|---|
| J | Polyacrylate Polymer B15 plus 25% Dow Plastic Pigment 722 |

The same precoated paper described in Example 1 was used, and the method of application of the barrier coat, of Example 1, was also used. Thus, the precoated paper was blade coated on the wire side with the varying formulations at the rate of about 0.5 pounds per 3,300 square feet (dry basis). The paper, following drying, was then tested for water resistance using the Cobb test. Cockle tests and wet and dry Pick tests were also conducted on the respective papers.

Certain samples of the paper were rod coated with toluene, and other samples with a zine oxide suspension in toluene. The results are given in the following Table C.

In the following table, the term "uncoated" means no pre-coat under the barrier coat.

TABLE C

| | | No Treatment | | | Toluene Treated | | | ZnO Treated | | | | |
|---|---|---|---|---|---|---|---|---|---|---|---|---|
| Barrier Film Type | Base Paper Type | 2½ Min. Cobb Test | 10 Min. Cobb Test | Cockle Test Seconds | 2½ Min. Cobb Test | 10 Min. Cobb Test | Cockle Test Seconds | 2½ Min. Cobb Test | 10 Min. Cobb Test | Cockle Test Seconds | Wet Pick Test cm. | Dry Pick Test cm. |
| A | Precoat 10% P.P. | 1.93 | 12.26 | 102 | .8 | 8.0 | 131 | 1.1 | 1.8 | 110 | 7.0 | 3.9 |
| A | Precoat 0% P.P. | 8.63 | 26.48 | 40 | 4.6 | 20.1 | 44 | 1.1 | 2.6 | 202 | 7.1 | 2.6 |
| A | Uncoated | 18.52 | 34.18 | 5 | 17.52 | 32.44 | 8 | 2.72 | 10.26 | 23 | 3.2 | 3.8 |
| B | Precoat 10% P.P. | 4.07 | 22.1 | 58 | .4 | 4.0 | 160 | 1.3 | 2.1 | 143 | 11.3 | 8.9 |
| B | Precoat 0% P.P. | 7.76 | 28.17 | 36 | 3.0 | 18.3 | 66 | 1.2 | 2.3 | 171 | 6.3 | none |
| B | Uncoated | 20.58 | 35.34 | 5 | 17.48 | 32.45 | 8 | 3.72 | 10.96 | 23 | 6.9 | 12.0 |
| C | Precoat 10% P.P. | 19.61 | 31.40 | 13 | 8.22 | 26.92 | 20 | 1.02 | 5.72 | 48 | none | 17.2 |
| C | Precoat 0% P.P. | 16.71 | 29.96 | 14 | 7.68 | 24.40 | 21 | 1.10 | 4.95 | 43 | none | 11.8 |
| C | Uncoated | 24.60 | 36.81 | 6 | 23.04 | 35.33 | 6 | 7.48 | 20.32 | 14 | 2.5 | 4.8 |
| D | Precoat 10% P.P. | 21.0 | 35.9 | 18 | 4.7 | 23.5 | 52 | 1.5 | 5.3 | 178 | 19.8 | none |
| D | Precoat 0% P.P. | 17.23 | 31.81 | 13 | 3.36 | 20.36 | 22 | 1.50 | 4.22 | 52 | none | 16.2 |
| D | Uncoated | 24.88 | 37.66 | 6 | 21.20 | 32.79 | 7 | 6.96 | 20.40 | 18 | 3.8 | none |
| E | Precoat 10% P.P. | 18.26 | 32.38 | 12 | 6.01 | 21.38 | 30 | 3.38 | 14.82 | 36 | none | 7.2 |
| E | Precoat 0% P.P. | 17.08 | 33.50 | 12 | 11.03 | 27.94 | 20 | 3.76 | 13.65 | 32 | 19.1 | 8.6 |
| E | Uncoated | 22.40 | 39.24 | 7 | 15.84 | 32.16 | 8 | 7.18 | 17.25 | 18 | 2.7 | none |
| F | Precoat 10% P.P. | 20.6 | 34.1 | 18 | 3.9 | 18.1 | 39 | 2.6 | 12.1 | 100 | 17.2 | 13.7 |
| F | Precoat 0% P.P. | 19.10 | 35.20 | 12 | 6.03 | 23.46 | 26 | 3.40 | 11.55 | 37 | 18.1 | 10.0 |
| F | Uncoated | 27.45 | 41.66 | 6 | 22.26 | 35.58 | 8 | 8.08 | 22.05 | 16 | 1.4 | none |
| G | Precoat 10% P.P. | 15.90 | 31.37 | 22 | 1.86 | 18.90 | 38 | 1.46 | 4.20 | 58 | 16.6 | none |
| G | Precoat 0% P.P. | 17.66 | 32.02 | 14 | 3.82 | 23.06 | 36 | .54 | 3.80 | 78 | 16.2 | 10.1 |
| G | Uncoated | 26.02 | 38.42 | 6 | 20.99 | 36.35 | 8 | 7.90 | 22.72 | 17 | 3.3 | 10.6 |
| H | Precoat 10% P.P. | 18.96 | 32.94 | 23 | 1.00 | 5.25 | 75 | .67 | 3.38 | 105 | none | 19.8 |
| H | Precoat 0% P.P. | 19.29 | 32.06 | 12 | .92 | 10.17 | 62 | 1.00 | 2.38 | 58 | 12.6 | none |
| H | Uncoated | 26.62 | 38.00 | 6 | 19.21 | 33.04 | 8 | 6.56 | 21.71 | 20 | 2.4 | none |
| I | Precoat 10% P.P. | 18.64 | 30.86 | 13 | 6.62 | 22.16 | 32 | 3.10 | 12.46 | 35 | none | 6.2 |
| I | Precoat 0% P.P. | 16.62 | 31.07 | 18 | 8.56 | 26.44 | 18 | 5.02 | 14.84 | 32 | 15.3 | 16.4 |
| I | Uncoated | 24.80 | 37.85 | 6 | 24.12 | 37.07 | 8 | 9.16 | 22.17 | 16 | 2.7 | 5.0 |
| J | Precoat 10% P.P. | 18.9 | 38.5 | 26 | 3.2 | 23.9 | 56 | 1.6 | 13.2 | 131 | none | none |
| J | Precoat 0% P.P. | 14.65 | 29.35 | 12 | 4.64 | 18.39 | 28 | 3.44 | 11.12 | 35 | none | 18.0 |
| J | Uncoated | 24.62 | 38.36 | 6 | 22.42 | 35.77 | 7 | 8.21 | 21.57 | 15 | 4.0 | 15.7 |

It can be seen from the data of Table C that optimum results were obtained using the ethylene acrylic polymer Dow XD8931.

This example also shows that the plastic particles need not be in the pre-coat to have an improvement in water resistance after toluene or zinc oxide treatment, but that the presence of plastic particles in the pre-coat permits a substantial improvement, in both the 2½ minute and 10 minute Cobb tests. For instance, where the film-forming polymer is ethylene acrylic acid copolymer (formulation B) an improvement of 22.1 to 4.0, for the 10 minute Cobb test, with 10% plastic particles in the pre-coat, is achieved, compared to an improvement from 28.17 to 18.3 for the case where the pre-coat has no plastic particles.

On all papers, those with no pre-coat, those with pre-coats containing plastic particles, and those with pre-coats having no plastic particles, a very large resistance in the dry pick on zinc oxide coated masters was observed between sheets which did and did not have plastic particles in the barrier coat. Again, this example shows that both excellent pick resistance and good water resistance can be obtained by using 20 to 40% plastic particles with the film-forming polymer.

Optimum results are achieved in the present invention with the use of copolymers of acrylic, methacrylic or crotonic acid and such olefins as ethylene and propylene. Such copolymers are described in prior U.S. Pat. No., 3,520,861, incorporated by reference herein. Advantageously, the copolymers are sold as the ammonium salts thereof so that they are soluble or dispersible in water. Thus they can be readily applied as coatings to a desired substrate and upon drying revert to the acid copolymer with evolution of ammonia gas.

Further details of the copolymers are described in prior U.S. Pat. Nos. 3,799,901; 3,541,033; 3,674,896; and 3,741,925; also incorporated by reference herein. As described in these patents, the copolymers broadly comprise an ethylenically unsaturated polymerizable monomer having non-polar functionality and a polymerizable olefinically unsaturated monomer having polar functionality. In the present invention, the unsaturated polymerizable monomer having non-polar functionality is selected to contribute water resistance to the copolymer and is present in an amount of at least about 60%. The unsaturated monomer having polar functionality is selected to contribute dispersibility to the copolymer in water, and is present in the proportion of about 3 to about 40%. Included within the scope of the present invention are multipolymers, comprising, by way of example, two different non-polar monomers polymerized with the olefinically unsaturated monomer having polar functionality.

As set forth in the aforementioned patents, suitable ethylenically unsaturated polymerizable monomers include aliphatic olefins, aromatic olefins, unsaturated esters, vinyl and vinylidene chloride, vinyl ether, acrylamide and acrylonitrile. Suitable olefinically unsaturated monomers having polar functionality are the olefinically unsaturated organic carboxylic acids such as acrylic acid, methacrylic acid and crotonic acid.

A significant advantage of the copolymers of the present invention is that they can be employed at very low coat weights, for instance as low as about 0.1 to about 2 pounds per side per 3,300 square feet, dry basis, on one or both sides of said base, without significant change in conductivity of the master. At the same time, superior water resistance is obtained. Additional coat weights up to about 20 pounds per side per 3,300 square feet can be applied on the inclusion of conductive agents in the barrier coat.

It is possible to include in the barrier coat other film-forming compositions, for instance polyvinyl alcohol as disclosed in prior U.S. Pat. No. 3,674,896. Also, it is within the scope of the present invention to employ cross-linking agents with the polymer.

An aspect of the present invention resides in adding to the film-forming formulation an amount of a non-fugitive base such as sodium carbonate or quaternary ammonia compounds which complex with the acid copolymer on drying to form a salt. The use of this technique improves conductivity of the barrier film but at the expense of some water resistance.

Throughout this application, reference has been made to the use of paper as the film-forming base, It is understood that the present invention is applicable to the use of substrates other than paper, where water resistance is desired, for instance Mylar, cotton bases, synthetic fiber bases, polyester bases, synthetic pulps and mixtures with cellulose fibers.

For purposes of the present application, it is important to distinguish between formation of a barrier coat and sizing a paper base. In the art, sizing refers to a reasonably uniform deposition of material throughout the fibrous mat, generally to obtain water resistance. By contrast, a barrier coat exists as a continuous or semi-continuous film at the surface of the mat. To achieve this, the use of a smoothing pre-coat, or alternatively a smooth and highly sized raw stock, is employed. In addition, a sizing formulation normally employs a solids content, in an aqueous dispersion, of about 0.1–5%. The barrier coat formulations of the present invention preferably have a solids content of about 20–40%.

What is claimed is:

1. A method for the preparation of electrostatic masters having improved water resistance for lithographic printing comprising the steps of;

(a) applying to a base a barrier coat formulation consisting essentially of, on a dry weight basis, at least 50% of a synthetic or natural film-forming hydrophobic polymer and about 2.5–50% of plastic particles having solvent sensitivity;

(b) drying the formed barrier coat, said plastic particles being in a non-coalesced state at time of application and at least substantially non-film-forming under the conditions of application and drying of the coating;

(c) applying to said barrier coat a photoconductive coating comprising a photoconductive material and binder;

(d) said method including the wetting of said barrier coat by said solvent to which the plastic particles are sensitive, said plastic particles after wetting by said solvent being in an at least partially coalesced state in said barrier coat.

2. The method of claim 1 employing a paper base.

3. The method of claim 1 including the step of applying to said base a pre-coat underlying said barrier coat, said pre-coat having plastic particles in an amount sufficient to materially increase water resistance.

4. The method of claim 3 wherein said plastic particles in the pre-coat are present in an amount of about 10 to 40% based on the total weight of the pre-coat.

5. The method of claim 1 wherein said barrier coat formulation has a solids content of about 20–40% and is applied at a coat weight which is sufficiently low to avoid significant change in conductivity of the master, said barrier coat being applied to one or both sides of said base.

6. The method of claim 5 wherein said barrier coat formulation is applied at a coat weight from about 0.2 to about 20 pounds per side per 3,300 square feet and comprises about 20 to about 40% plastic particles, said coat having improved pick resistance and cockle resistance in addition to water resistance.

7. The method of claim 1 wherein said film-forming polymer is selected from the group consisting of; co- and multipolymers of ethylene or propylene and acrylic, methacrylic or crotonic acid; co- and multipolymers of polyvinyl acetate; co- and multipolymers of styrene-butadiene; esters of polyacrylic, methacrylic and crotonic acid and multipolymers thereof; co- and multipolymers of acrylic, methacrylic and crotonic acid and polyvinylidene chloride; and mixtures thereof.

8. The method of claim 7 wherein said plastic particles are materials selected from the group consisting of polystyrene, polyvinyl acetate and copolymers thereof, polyvinyl butyral and copolymers thereof, polyacrylate and copolymers thereof, and mixtures of any of the above.

9. The method of claim 8 wherein said plastic particles have an average particle size of about 0.01 to 20 microns.

10. The method of claim 1 wherein said photoconductive coating comprises a solvent, the solvent to which the plastic particles are sensitive being the photoconductive coating solvent.

11. The method of claim 1 including the step of wetting said barrier coat with the solvent to which the plastic particles are sensitive prior to application of the photoconductive coat.

12. An electrostatic master having improved water resistance for lithographic printing comprising a base;

a barrier coat overlying said base; and a photoconductive layer containing a photoconductive material and a binder applied to said barrier coat;

said barrier coat consisting essentially of at least 50% by weight, dry basis of a synthetic or natural film-forming hydrophobic polymer; and about 2.5–50% by weight of plastic particles having solvent sensitivity, said plastic particles being in an at least partially coalesced state in said barrier coat by contact with a solvent to which they are sensitive,

13. The electrostatic master according to claim 12 wherein said solvent is that employed in the application of the overlying photoconductive layer.

14. The electrostatic master of claim 13 further comprising an underlying pre-coat comprising binder and filler, at least 10% of said filler being plastic particles having such solvent sensitivity.

15. An electrostatic master having improved water and cockle resistance for lithographic printing comprising:

(a) a base;

(b) a barrier coat applied to said base; and (c) a photoconductive layer containing a photoconductive material and a binder applied to said barrier coat;

(d) said barrier coat comprising a copolymer of at least 60% ethylenically unsaturated polymerizable monomer having non-polar functionality and about 3 to about 40% of a polymerizable olefinically unsaturated monomer having polar functionality.

16. The master of claim 15 employing a paper base.

17. The master of claim 15 wherein said copolymer comprises ethylene polymerized with acrylic, methacrylic or crotonic acid.

18. An electrostatic master having improved water resistance for lithographic printing comprising a base;

a barrier coat applied to said base; and a photoconductive layer containing a photoconductive material and a binder applied to said barrier coat;

said barrier coat consisting essentially of, on a dry weight basis, at least about 50% of a synthetic or natural film-forming hydrophobic polymer and about 2.5–50% plastic particles, said plastic particles being in an at least partially coalesced state in said barrier coat.

19. The master of claim 18 employing a paper base.

20. The electrostatic master of claim 18 wherein said plastic particles have an average particle size of about 0.01 to 20.0 microns.

21. The electrostatic master of claim 18 wherein said plastic particles comprise about 20–40% of said barrier coat, said barrier coat being applied to one or both sides of said base at a coat weight, dry basis, of about 0.2 to about 20 pounds per side per 3,300 square feet.

22. The electrostatic master of claim 18 wherein said plastic particles are materials selected from the group consisting of polystyrene, polyvinyl acetate and copolymers thereof, polyvinyl butyral and copolymers thereof, polyacrylate and copolymers thereof, and mixtures of any of the above.

23. The electrostatic master of claim 18 wherein said film-forming polymer is selected from the group consisting of; co- and multipolymers of ethylene or propylene and acrylic, methacrylic or crotonic acid; co- and multipolymers of polyvinyl acetate; co- and multipolymers of styrene butadiene; esters of polyacrylic, methacrylic and crotonic acid and multipolymers thereof; co- and multipolymers of acrylic, methacrylic and crotonic acid and polyvinylidene chloride; and mixtures thereof.

24. The electrostatic master of claim 18 including a pre-coat underlying said barrier coat, said pre-coat having plastic particles in an amount sufficient to materially increase water resistance.

25. The electrostatic master of claim 24 wherein said plastic particles in the pre-coat are present in an amount of about 10–40% based on the total weight of the pre-coat.

26. The electrostatic master of claim 18 wherein said barrier coat comprises about 20 to about 40% plastic particles, said coat having improved pick and cockle resistance in addition to water resistance.

27. The master of claim 15 wherein said barrier coat comprises about 2.5 to about 50% plastic particles based on the weight of the barrier coat.

28. The master of claim 15 wherein said barrier coat is applied at a coat weight as low as about 0.2 pounds per side per 3,300 square feet, dry basis, said barrier coat being applied to one or both sides of said base without significant change in conductivity.

* * * * *